US008523048B1

(12) United States Patent
Spiegelman

(10) Patent No.: US 8,523,048 B1
(45) Date of Patent: Sep. 3, 2013

(54) GLASS PACKAGING ARTICLE

(76) Inventor: Jack Spiegelman, Duluth, GA (US)

( * ) Notice: Subject to any disclaimer, the term of this patent is extended or adjusted under 35 U.S.C. 154(b) by 404 days.

(21) Appl. No.: 12/546,131

(22) Filed: Aug. 24, 2009

Related U.S. Application Data

(60) Provisional application No. 61/138,117, filed on Dec. 16, 2008.

(51) Int. Cl.
*B65D 5/42* (2006.01)

(52) U.S. Cl.
USPC ..... 229/120.12; 229/104

(58) Field of Classification Search
CPC ..... B65D 5/42
USPC ..... 229/120.12, 120.23, 120.05, 120.11, 229/120.35; 206/433, 180, 182, 183, 185, 206/187, 188, 192
See application file for complete search history.

(56) References Cited

U.S. PATENT DOCUMENTS 1,020,878 A * 3/1912 Bendelari ..... 229/120.12
1,168,565 A * 1/1916 Rosenwald ..... 229/122.29
2,421,748 A * 6/1947 Fink ..... 206/418
2,828,902 A * 4/1958 Ringler ..... 206/583
2,874,833 A * 2/1959 Toensmeier ..... 206/149
2,927,721 A * 3/1960 Thatcher ..... 229/120.12
3,853,259 A * 12/1974 Tupper ..... 229/103
4,102,525 A * 7/1978 Albano ..... 248/174
4,121,752 A * 10/1978 Ravotto et al. ..... 206/486
4,223,827 A * 9/1980 Gilbert ..... 206/521
4,482,055 A * 11/1984 Boyle ..... 229/235
4,921,099 A * 5/1990 Trauschke ..... 206/418
5,299,734 A * 4/1994 Lane ..... 229/120.32
5,660,119 A * 8/1997 Perkins ..... 108/51.3

* cited by examiner

*Primary Examiner* — Gary Elkins
*Assistant Examiner* — Christopher Demeree
(74) *Attorney, Agent, or Firm* — Stephen J. Stark; Miller & Martin PLLC

(57) ABSTRACT

An article may include a single piece of material, such as corrugated cardboard, with scores situated such that when folded along the scores a square or rectangular container is formed with first and second adjacent triangular subcontainers. The article may include locking tabs to join the first triangular subcontainer with slots in the second triangular container which results in a near square box. The insert subcontainers complete with 2 bottles are then placed in a box for shipping. The added protection and buffer zones provide additional protection in the event the carton receives a sudden impact such as being dropped.

18 Claims, 9 Drawing Sheets

Figure 3 (Figure 2 Open End View)

Figure 4 Closed End View

Figure 5 LOCKING TAB

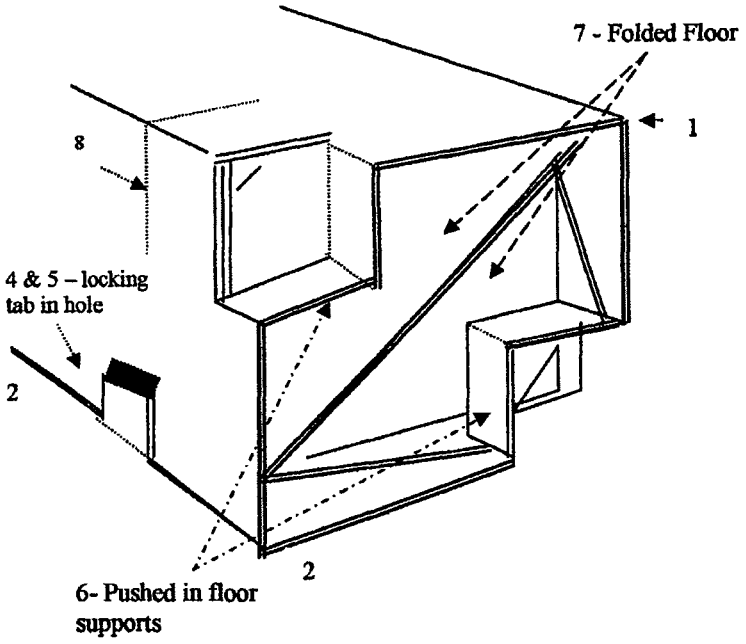
Figure 8 Closed End View

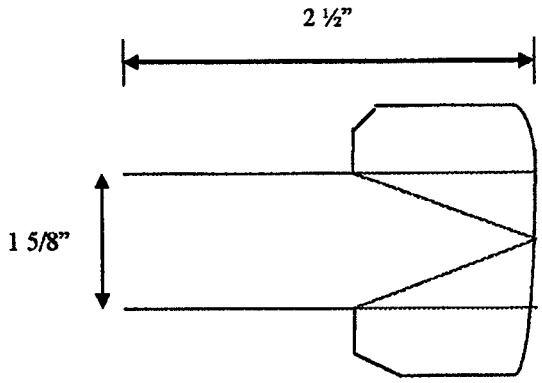
Figure 9 – Alternate Locking Tab

GLASS PACKAGING ARTICLE

CLAIM OF PRIORITY

This application claims the benefit of U.S. Provisional Patent Application No. 61/138,117 filed Dec. 16, 2008.

TECHNICAL FIELD

The present disclosure relates to inserts designed for glass shipping and packaging articles.

BACKGROUND

Articles for packaging and/or shipping glass, and bottles in particular, should be affordable and robust. They should be able to damped vibration and absorb shock from a variety of angles. They should be easy to build and "green", that is, environmentally friendly for disposal. They should be durable and light weight and take less storage space than more expensive styrofoam.

BRIEF DESCRIPTION OF THE DRAWINGS

The particular features and advantages of the invention as well as other objects will become apparent from the following description taken in connection with the accompanying drawings in which:

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

FIG. 8 is a closed end view illustration of an alternative embodiment of the article of FIG. 6 formed into a glass package.

FIG. 9 is an illustration of an alternative embodiment of an unformed glass package

DETAILED DESCRIPTION OF THE DRAWINGS

References to "one embodiment" or "an embodiment" or an "alternative embodiment" do not necessarily refer to the same embodiment, although they may.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
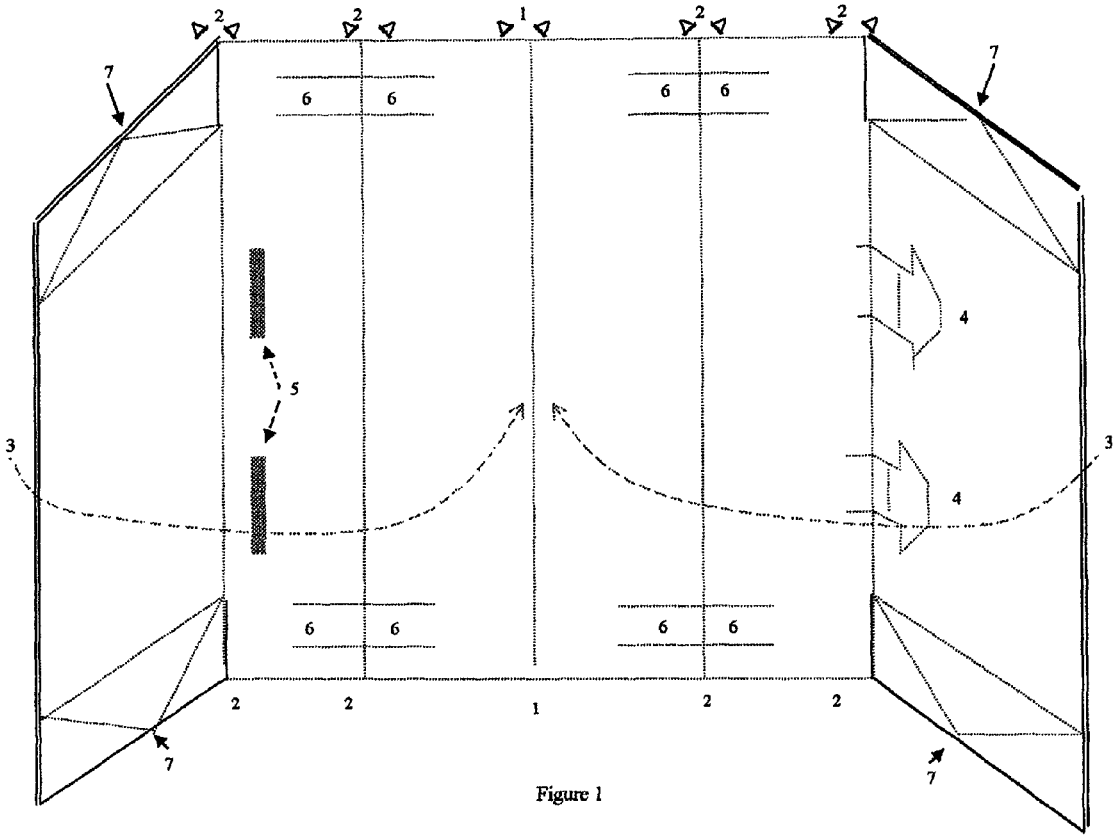
FIG. 1 is an illustration of an embodiment of an unformed glass package.

FIG. 1 is an illustration of an embodiment of an unformed glass package. The following description [0009] of the article of FIG. 1 describes tolerances, measurements, materials, etc. which are exemplary for the application and which are not necessarily the values that would apply in every application and/or embodiment of the invention. The described embodiments are distinguished from conventional four-sided containers or inserts currently used for most bottles. Instead it comprises three sides per bottle in a triangular subcontainer providing the bottle secure seating and space for enhanced impact protection.

Figure 6:
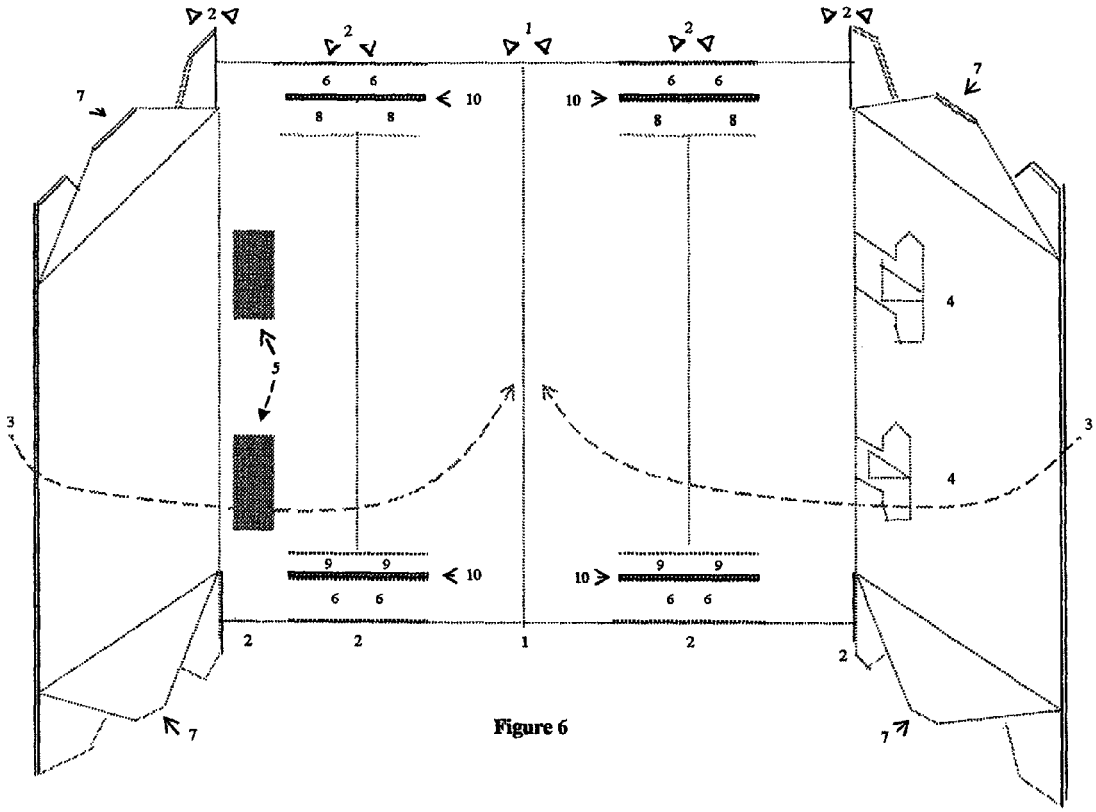
FIG. 6 is an alternative illustration of an embodiment of an unformed glass package

FIG. 6 is an illustration of an alternative embodiment of an unformed glass package. The following description [0009] of the article of FIG. 6 describes tolerances, measurements, materials, etc. which are exemplary for the application and which are not necessarily the values that would apply in every application and/or embodiment of the invention. The described embodiments are distinguished from conventional four-sided containers or inserts currently used for most bottles. Instead it comprises three sides per bottle in a triangular subcontainer providing the bottle secure seating and space for enhanced impact protection.

The exemplary article(s) in paragraph [0007] and [0008] are made out of 40-ECT or some other strength corrugated board which is strong enough to support the weight load. The final box may hold two liquid bottles of wine or liquor, in which three sides are folded together on the left side to join with three sides folded together on the right side (see joints 1, 2 and arrows, 3). The end result is a "box" with a double triangle divider between the two bottles. The two folded triangles are then "locked" into position by the insertion or pushing of a (for example) 3¾" locking tab (see 4) scored on one (for example) 7" outside panel into reciprocal holes cutout on the opposite (for example) 5⅛" folded panel (see 5). The locking tab holes may be ⅜"×3½" cutouts or some other size as illustrated in FIG. 6. The outside panels (see 7) are scored for a folding "floor" and top for each bottle. The floor and top are then reinforced by some push in scores 6 (e.g. 1¼" thick) which fit in directly under the folded floors. This allows for the bottom and top panel bottle support. The push in components may or may not, for example, provide for a 1¼" buffer space below the push in components which can be utilized for "climate" temperature control environment to protect the integrity of the bottle and its contents as in FIG. 1 and FIG. 4. They may also fold without providing utilization space for "climate" temperature control as in FIG. 6 and FIG. 9. Allowances are also made within the alternative embodiment (FIG. 6) for a NS-bottle stabilization tab (see 8) and a SBT short bottle tab (see 9) designed to shorten and close the triangular bottle cavity to securely fit and protect shorter and narrower bottle sizes. Space has been cutout to allow ease of folding equivalent to the width 3/16" of the corrugated board for the two NS and SBT bottle tabs (see 10)

The over all dimensions of the box may be 40" by 19½". Four of the inner panels may be 6" inches wide or some other similar sized dimension serving the same purpose for larger or different size containers. The two outer panels may be 8" long enough to make a square box when touching each other after being folded. A 19½" height of the box may allow for an approximate 1" cushion below the two folded scores which fit under the floor. It is also possible to make this box 40"×17½" by eliminating the 1" cushion on both the top and bottom of the box. The finished measurements of the folded container once locked into position after folding and joining all scores may be: 17¼"×6"×6" as in FIG. 1 or 16¾"×6"×6" as in FIG. 6.

The joined triangular subcontainers may form a "square" box where each bottle is surrounded by cardboard sides which create a buffer zone for bottle movement in the event of impact. The resulting insert may be sufficient to hold two 3½" wide by 13¼" tall glass bottles. Each bottle is surrounded within the container by no less than two cardboard layers or dividers when placed into the outside shipping box.

Figure 2:
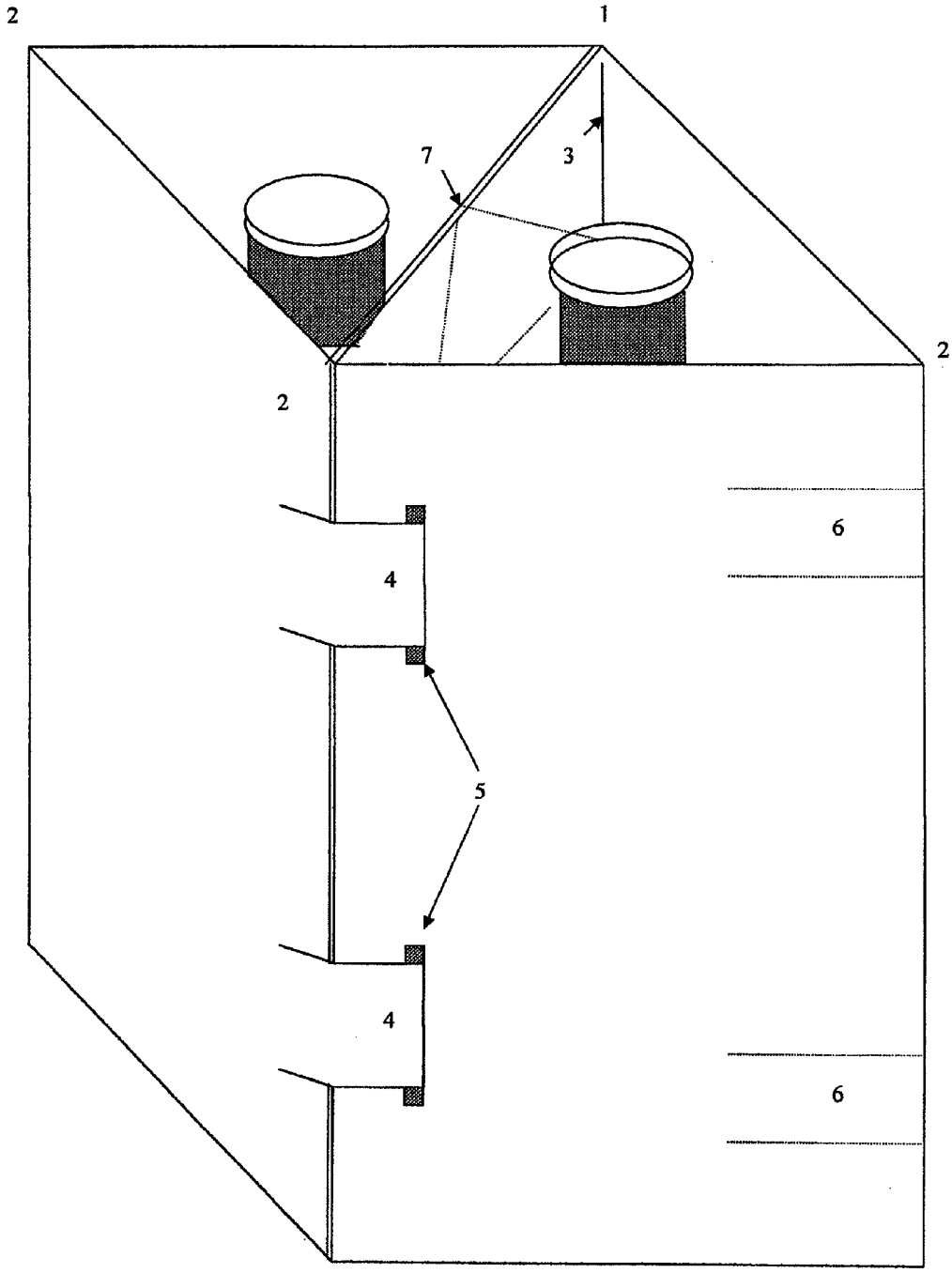
FIG. 2 is a side view illustration of an embodiment of the article of FIG. 1 formed into a glass package.
Figure 3:
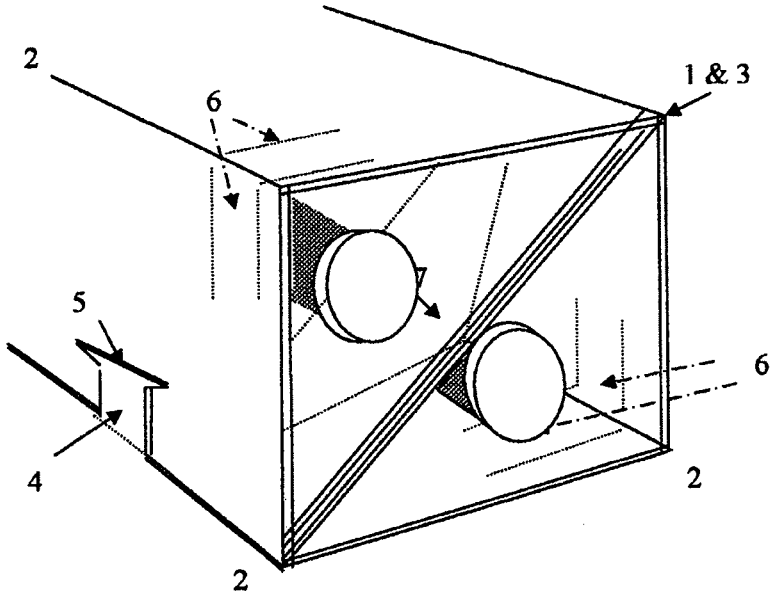
FIG. 3 is an open end view illustration of an embodiment of the article of FIG. 1 formed into a glass package.
Figure 4:
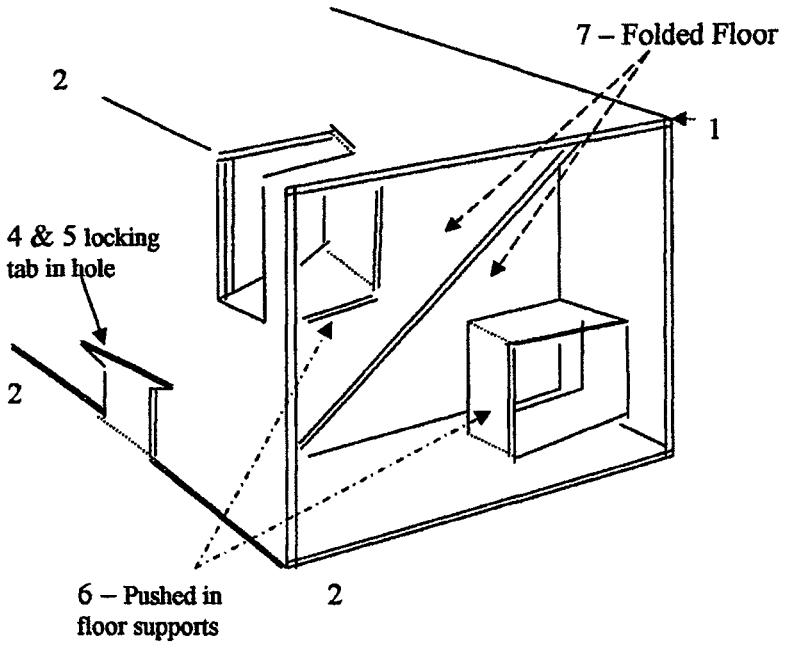
FIG. 4 is a closed end view illustration of an embodiment of the article of FIG. 1 formed into a glass package.
Figure 5:
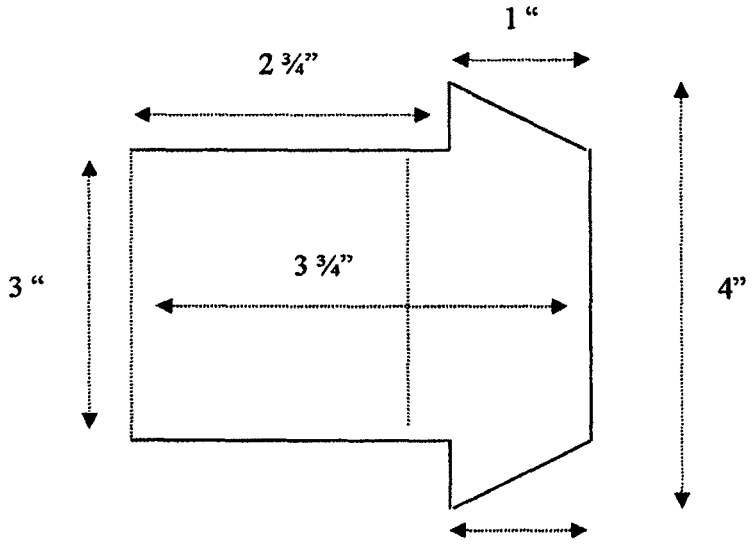
FIG. 5 is an illustration of an embodiment of a locking tab.
Figure 7:
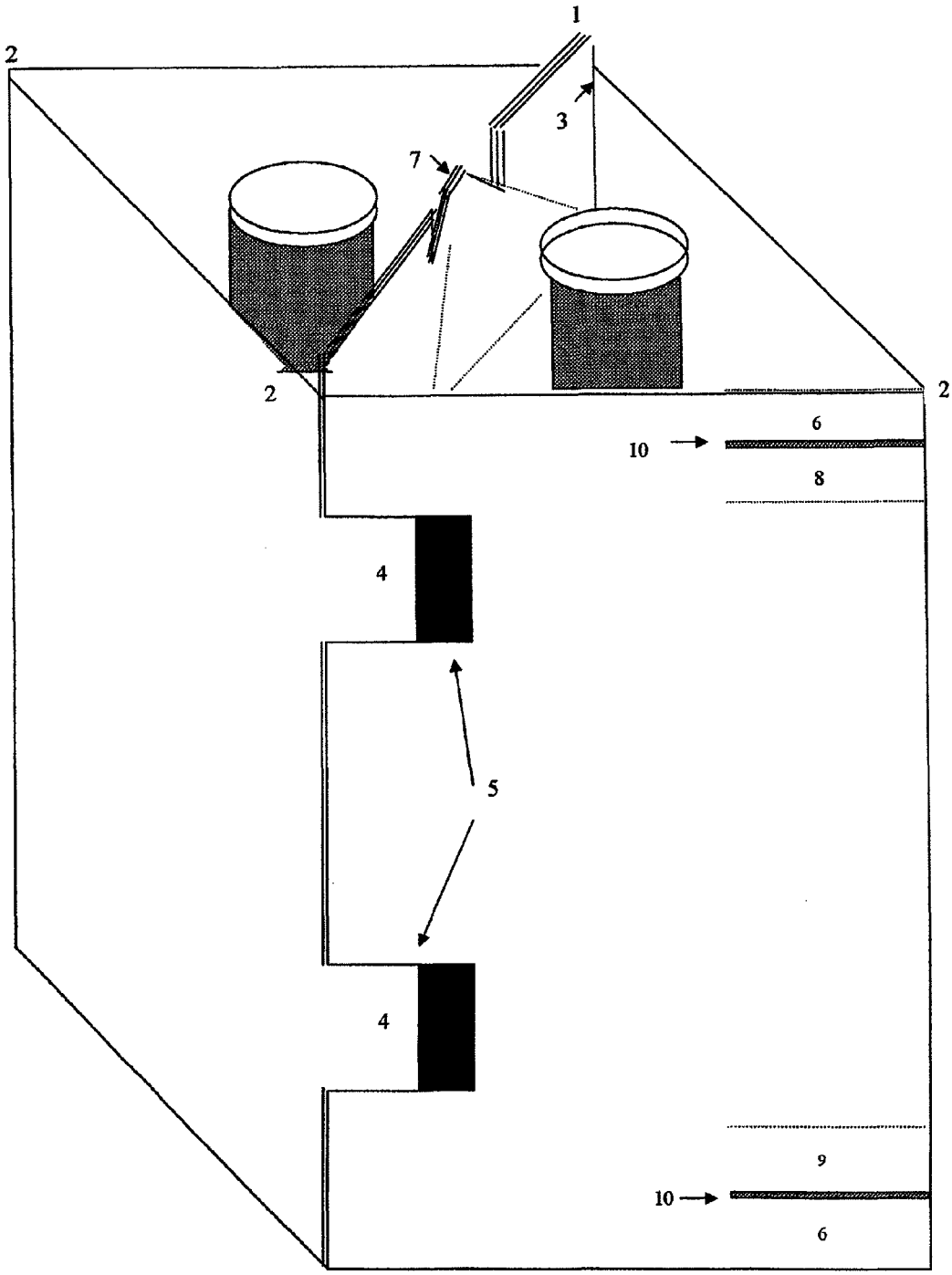
FIG. 7 is a side view illustration of an alternative embodiment of the article of FIG. 6 formed into a glass package

FIG. 2 is a side view illustration of an embodiment of the exemplary article of FIG. 1 formed into a glass package and FIG. 7 is a side view illustration of an alternative embodiment of the exemplary article of FIG. 6 formed into a glass package. FIG. 3 is an open end view illustration of an embodiment of the article of FIG. 1 formed into a glass package. FIG. 4 is a closed end view illustration of an embodiment of the article of FIG. 1 formed into a glass package. FIG. 8 is a closed end view illustration of an alternative embodiment of the article of FIG. 6 formed into a glass package. FIG. 5 is an illustration of an embodiment of a locking tab. FIG. 9 is an illustration of an alternative embodiment of a locking tab.

The foregoing described aspects depict different components contained within, or connected with, different other components. It is to be understood that such depicted arrangements are merely exemplary, and that in fact other arrangements may be implemented within the scope of the inventive features.

The described embodiments of package inserts may be employed to ship multiple bottles of wine or liquor in a safe and friendly environment. These embodiments may be more economical to store and purchase than Styrofoam products. The inserts may be stored in flat bundles and require very little storage space. The cardboard is durable and light weight. More than one insert may be used within a shipping box. For example, one could place six inserts into a box for shipping twelve bottles, or four inserts to ship eight bottles, two inserts for four bottles or a single insert to ship two bottles of wine.

This patent application and related descriptions incorporate by reference Provisional Application No. 61/138,117.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An article comprising:

a single piece of material with parallel scores situated creating two pairs of first, second and third sides such that when folded along the scores a square or rectangular outer perimeter container is formed having first and second adjacent triangular subcontainers with the subcontainers having their third sides adjacently disposed internal to the container along a diagonal of the container, and the subcontainers each having a floor extending perpendicular to the scores defining the sides with the floor displaced a predetermined buffer space above a bottom of the first and second sides and the floor scored relative to the third side and extending directly from and bent perpendicular relative to the third side above the buffer space and at least partially retained in position by floor supports cut from and extending from the first and second sides.

2. The article of claim 1 further comprising:

locking tabs to join the first triangular subcontainer with slots in the second triangular subcontainer.

3. The article of claim 2 further comprising:

push in components disposed toward the top of the first and second sides to shorten cavities internal to the first and second triangular sub containers.

4. The article of claim 1 further comprising:

the single piece of material is corrugated cardboard.

5. The article of claim 1 further comprising:

panels scored on at least one of the sides of each of the triangular subcontainers to form a top panel on each triangular subcontainer.

6. The article of claim 1 wherein floor supports are push in components reinforcing the floor.

7. The article of claim 1 further comprising:

dimensions suitable for storing wine bottles.

8. The article of claim 1 wherein the floor supports extend from the first and second sides as first push in components and project inwardly toward the third side when pushed in and respectively directly contact the floors.

9. The article of claim 8 further comprising second push in components extending from the first and second sides which project inwardly toward the third side when pushed in and are located above the floors.

10. The article of claim 9 further comprising third push in components extending from the first and second sides which project inwardly toward the third side when pushed in and are located above the second push in components.

11. The article of claim 10 further comprising fourth push in components extending from the first and second sides which project inwardly toward the third side when pushed and are located above the third push in components.

12. A single piece of material with parallel scores situated creating two pairs of first, second and third sides such that when folded along the scores a square or rectangular outer perimeter container is formed having first and second adjacent triangular subcontainers with the subcontainers having their third sides adjacently disposed internal to the container along a diagonal of the container having first push-in components extending from the first and second sides which project inwardly toward the third side when pushed in wherein a buffer space is located below the first push in components above a bottom of the first and second sides and a floor extends integrally and directly at a bend from each of the third sides towards the first and second sides above the buffer space and is retained in position at least partially by the push-in components.

13. The article of claim 12 further comprising second push-in components extending from the first and second sides which project inwardly toward the third side when pushed in and a floor is located between the first and second push-in components.

14. The article of claim 13 wherein the floor extends from the third side and is in direct contact with the second push-in component.

15. The article of claim 12 further comprising third push-in components extending from the first and second sides projecting inwardly toward the third side when pushed in and a buffer space is located above the third push-in components and below a top of the sides.

16. The article of claim 15 further comprising fourth push-in components extending from the first and second sides projecting inwardly toward the third side when pushed in and are located above the third push in components.

17. The article of claim 16 further comprising a top panel extending from the third sides towards the first and second sides of the subcontainers and entrapped between the third and fourth push-in components.

18. The article of claim 17 wherein the top panel directly contacts the fourth push in components.

* * * * *